US006865281B1

(12) United States Patent
Jordan

(10) Patent No.: US 6,865,281 B1
(45) Date of Patent: Mar. 8, 2005

(54) LIQUID COOLED SPEAKER

(76) Inventor: Jeff B. Jordan, 19322 Creek Round Ave., Baton Rouge, LA (US) 70817

( * ) Notice: Subject to any disclaimer, the term of this patent is extended or adjusted under 35 U.S.C. 154(b) by 453 days.

(21) Appl. No.: 09/670,913

(22) Filed: Sep. 28, 2000

(51) Int. Cl.[7] ..... H04R 25/00
(52) U.S. Cl. ..... 381/397; 381/420
(58) Field of Search ..... 381/397, 415, 381/165, 166, 412, 420

(56) References Cited

U.S. PATENT DOCUMENTS

| | | | | | |
|---|---|---|---|---|---|
| 2,261,110 | A | * | 11/1941 | Engholm | 381/189 |
| 4,479,035 | A | * | 10/1984 | Philippbar | 381/409 |
| 5,060,274 | A | * | 10/1991 | Asami et al. | 381/166 |
| 5,426,707 | A | * | 6/1995 | Wijnker | 381/397 |
| 5,430,804 | A | * | 7/1995 | Wijnker | 381/410 |
| 6,243,479 | B1 | * | 6/2001 | Proni | 381/420 |
| 6,373,957 | B1 | * | 4/2002 | Stewart | 381/397 |
| 6,390,231 | B1 | * | 5/2002 | Howze | 181/148 |
| 6,535,613 | B1 | * | 3/2003 | Ssutu | 381/397 |

FOREIGN PATENT DOCUMENTS

| | | | |
|---|---|---|---|
| FR | 0012070 A1 | * | 6/1980 |
| JP | 55-26738 | * | 2/1980 |
| JP | 55-016546 A | * | 2/1980 |
| JP | 0345804 A2 | * | 12/1989 |
| JP | 3-191700 A | * | 8/1991 |
| JP | 8-102994 | * | 4/1996 |

* cited by examiner

*Primary Examiner*—Duc Nguyen
*Assistant Examiner*—Phylesha Dabney
(74) *Attorney, Agent, or Firm*—Roy, Kiesel, Keegan & DeNicola

(57) ABSTRACT

A fluid cooled speaker having a T-yoke with a pole piece, a magnet surrounding the pole piece, a voice coil positioned between the pole piece and the magnet, and a cone connected to the voice coil. The T-yoke includes a body having a base and a pole piece with a sealed cavity formed within the pole piece. The T-yoke also has a fluid inlet and outlet formed in the body and communicating between the cavity and an area outside the body of the T-yoke.

6 Claims, 6 Drawing Sheets

Front View
Fitting Installed

Sect. A-A
Fitting Installed

Sect. A-A

LIQUID COOLED SPEAKER

BACKGROUND OF THE INVENTION

I. FIELD OF THE INVENTION

This invention relates to loudspeakers for music systems. More particularly, this invention relates to loudspeakers which may be water cooled to provide higher sound quality.

Conventional loudspeakers (speakers) used in modern music systems must be capable of producing high sound quality at many different power levels. Speakers typically include a permanent magnet for generating a magnetic field and a yoke assembly. The yoke assembly has a T-yoke, and a magnet/plate pieces for focusing the magnetic field to an air gap in which the field is particularly intensified. A voice coil is suspended in the air gap so as to be capable of vibrating. A current is passed through the voice coil and the interaction of the magnetic field induced by the current and the field from the permanent magnet causes the voice coil to vibrate. The voice coil is connected to a speaker cone which has a large surface area to vibrate air in the vicinity of the cone and thus produce sound.

One factor which adversely affects the life of the speaker is excessive heat generated in the voice coil. This heat is mainly caused by the inherent impedance of the wire in the voice coil. The voice coils in speakers have a typical operating temperature range of approximately 150° F. to 200° F. When the voice coil begins to significantly exceed the range; for example approximately 300° F., the voice coil may be damaged. This damage could include the coil windings becoming de-laminated from the former or the adhesive between various other speaker parts breaking down. Such damage may cause outright speaker failure or at the very least, substantial shortening of the effective life of the speaker. Another problem caused by excessive heating is an increase in impedance in the voice coil which reduces the amount of power converted to sound. Of course, the increasing impedance is self-perpetuating in that a higher impedance results in more heat which in turn creates still higher impedance. While attempts have been made in the prior art to induce some air flow cooling within the speaker, this mechanism is generally insufficient to provide the cooling needed to prevent damage to the voice coil.

What is needed in the art is a speaker which can be efficiently constructed and operated to accomplish water (or other liquid) cooling of a speaker.

II. OBJECTS AND SUMMARY OF INVENTION

It is therefore an object of this invention to provide an improved speaker which substantially reduces the amount of heat to which the voice coil is exposed.

It is a further object to provide a speaker which includes a liquid cooling mechanism.

It is a further object to provide a fluid cooled T-yoke which will cool a speaker of which the T-yoke is an element.

Therefore the present invention provides a fluid cooled speaker having a T-yoke with a pole piece, a magnet surrounding the pole piece, a voice coil positioned between the pole piece and the magnet, and a cone connected to the voice coil. The T-yoke includes a body having a base and a pole piece with a sealed cavity formed within the pole piece. The T-yoke also has a fluid inlet and outlet formed in the body and communicating between the cavity and an area outside the body of the T-yoke.

III. BRIEF DESCRIPTION OF THE DRAWINGS

FIGS. 5A–5C represent another alternate embodiment of the fluid cooled T-yoke and speaker of the present invention.

IV. DETAILED DESCRIPTION OF THE INVENTION

Figure 1B:
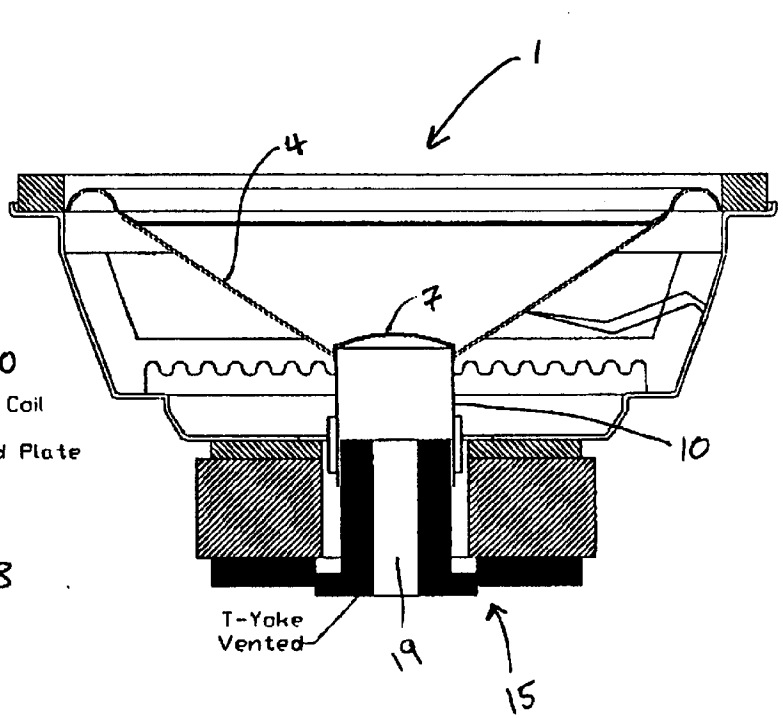
FIG. 1B PRIOR ART
FIG. 1B is a cross-sectional view of a typical prior art speaker having a vented T-yoke.
Figure 1A:
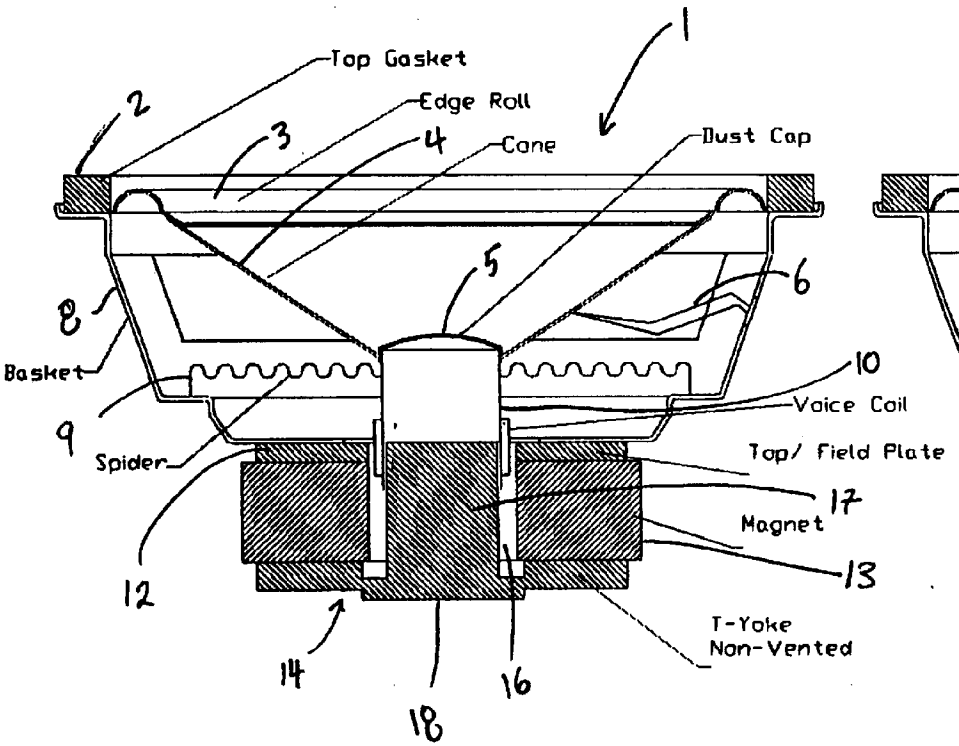
FIG. 1A PRIOR ART
FIG. 1A is a cross-sectional view of a typical prior art speaker having a non-vented T-yoke.
Figure 2:
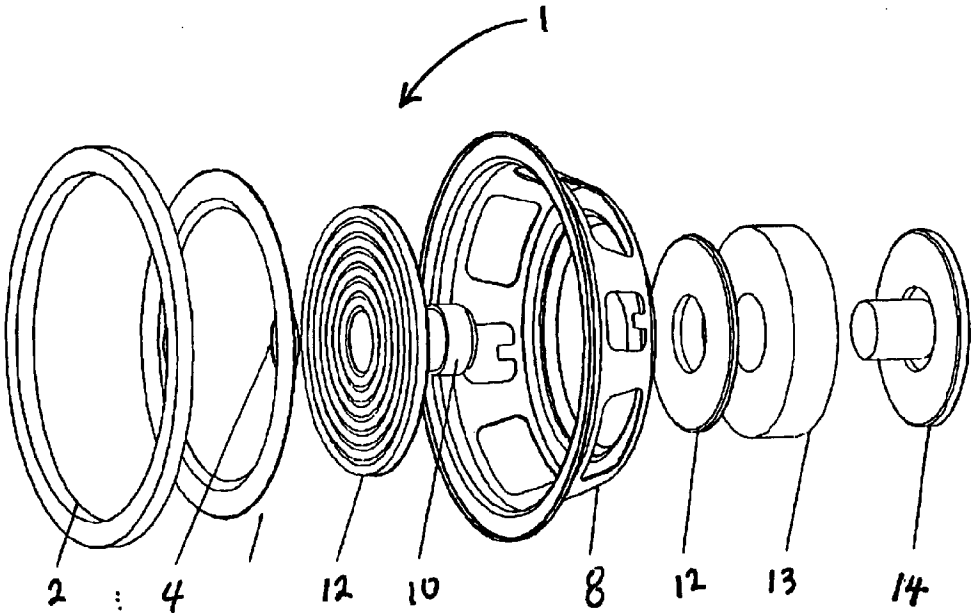
FIG. 2 PRIOR ART
FIG. 2 is an exploded view of a typical prior art speaker.

FIG. 1A illustrates a cross-sectional view of prior art speaker 1 while FIG. 2 is an exploded view of speaker 1. Speaker 1 is formed from a basket 8 with a cone 4 positioned therein. Cone 4 terminates on the upper perimeter of basket 8 with an edge roll 3 and a top gasket 2 helping to secure cone 4 in basket 8. It can be seen how cone 4 is connected at its lower perimeter to voice coil former 10. Voice coil former 10 will included a cylindrical tubular member constructed of a material such as aluminum and will have voice coil formed by numerous turns of electrical wiring (normally copper or aluminum) wrapped around the former tube. As used herein, the term "voice coil" may be used to refer either to the former with the wire voice coil wrapped thereon or simply the coil of wiring itself. A dust cap 5 will be positioned on voice coil 10.

Positioned below voice coil former 10 is a T-yoke 14 which is formed of two integral parts, base 18 and pole piece 17. A permanent magnet 13, which is annular in shape and has an aperture there through, is positioned such that magnet 13 rests on T-yoke base 18 with pole piece 17 extending though the aperture in magnet 13. A field plate 12 is positioned between magnet 13 and the bottom of basket 8. The speaker will be maintained as a unitary assembly by fixing field plate 12 to basket 8 and magnet 13 while base 18 of t-yoke 14 is fixed to magnet 13. FIG. 1A also shows a damper 9 connected between voice coil former 10 and an inside, lower perimeter of basket 8. Damper 9 acts to maintain the voice coil in alignment and aids as a mechanical damper. Wire leads 6 will extend through basket 8 and cone 4 in order to connect to the voice coil. It can be seen in FIG. 1A that an air gap 16 is formed between pole piece 17 and magnet 13 (including field plate 12). Voice coil former 10 is slidingly mounted on pole piece 17. When an electrical signal is fed to wire leads 6, a magnetic field is induced in the voice coil which in turn reacts with the field set up by permanent magnet 13. These interacting magnetic fields causes voice coil former 10 (and connected cone 4) to vibrate and produce sound.

As power is passed into the voice coil, heat is generated by the inherent impedance of the coil wiring and to a lesser degree by friction produced by the movement of the voice coil. A substantial portion of the heat in the voice coil is transferred to the pole piece. Thus cooling the T-yoke will help cool the voice coil. As noted above, if the temperature in the speaker components becomes too high, the voice coil is adversely affected. One solution attempted by the prior art is to provide an air passage 19 through a vented T-yoke 15 as seen in FIG. 1B. It is intended that the movement of cone 4 will induce a pumping action which will draw air into passage 19 and then expel it back out passage 19. Alternatively, dust cap 7 could be made from permeable material which would allow additional air exchange through dust cap 7. While this design may provide some cooling effect of T-yoke 15, the heat transfer rate between T-yoke 15 and air is significantly less than the heat transfer rate between a T-yoke and a circulating liquid.

Figures 3A, 3B, 3C, 3D, 4A, 4B, 4C:
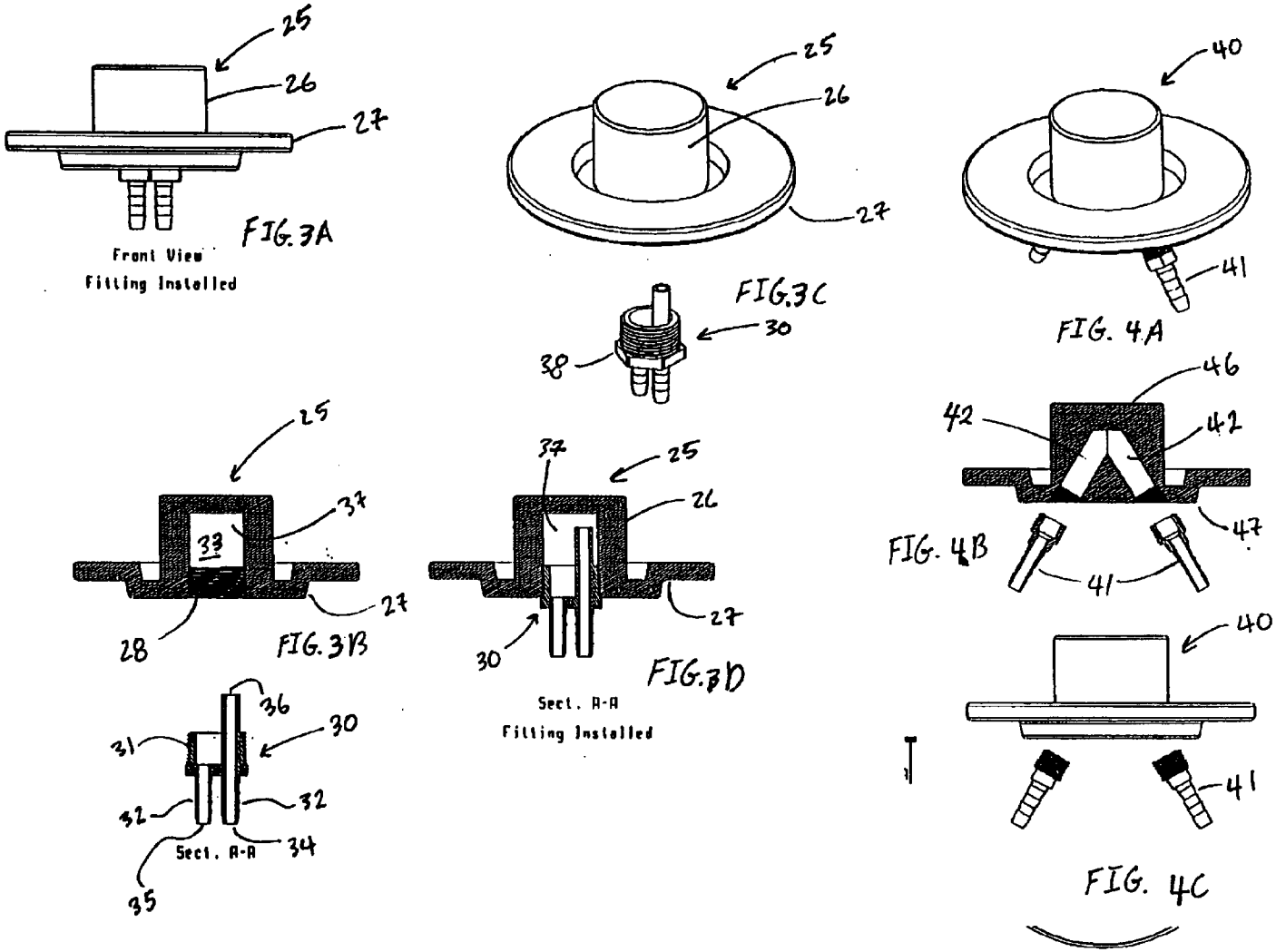
FIGS. 3A–3D represent one embodiment of the fluid cooled T-yoke and speaker of the present invention.
FIGS. 4A–4C represent an alternate embodiment of the fluid cooled T-yoke and speaker of the present invention.

FIGS. 3A–3D provide one preferred embodiment of the present invention, liquid cooled T-yoke 25. T-yoke 25 will generally comprise a pole piece 26 and a base 27. FIG. 3B illustrates how an interior cavity 33 will be formed in pole piece 26. A threaded base aperture 28 communicating with cavity 33 which will be formed in base 27. FIG. 3B also illustrates a base plug 30 having threaded surface 31 and barbed hose fittings 32 extending from fluid inlet 34 and fluid outlet 35. Base plug 30 also has an extension tube 36 extending above the height of threaded surface 31. While extension tube 36 is shown connected to inlet 34, it will be understood that extension tube 36 could just as readily be attached to outlet 35. FIG. 1C best illustrates how base plug 30 will further include a polygonal gripping surface 38 adapted for application of a wrench or similar tool. FIG. 1D illustrates how base plug 30 will be inserted into threaded base aperture 28 of T-yoke 25 and form a fluid tight seal between base aperture 28 and plug 30. When base plug 30 is inserted into T-yoke 25, extension tube 36 will be positioned in the upper portion 37 of cavity 33. In this manner, extension tube 36 helps insure that fluid will circulate through all portions of cavity 33 and effect the greatest heat transfer.

An alternate embodiment of the T-yoke is seen in FIGS. 4A–4C. T-yoke 40 differs from the previous embodiment in that the water circulating cavity is formed by way of two intersecting passages 42 being drill through base 47 into the interior of pole piece 46. Threaded fluid hose fittings 41 may then be inserted into passages 42 in order to form a fluid inlet and outlet through fittings 41. Again hose fittings 41 have barbs which aid in retaining the hose on fittings 41.

Figures 6A, 6B, 6C:
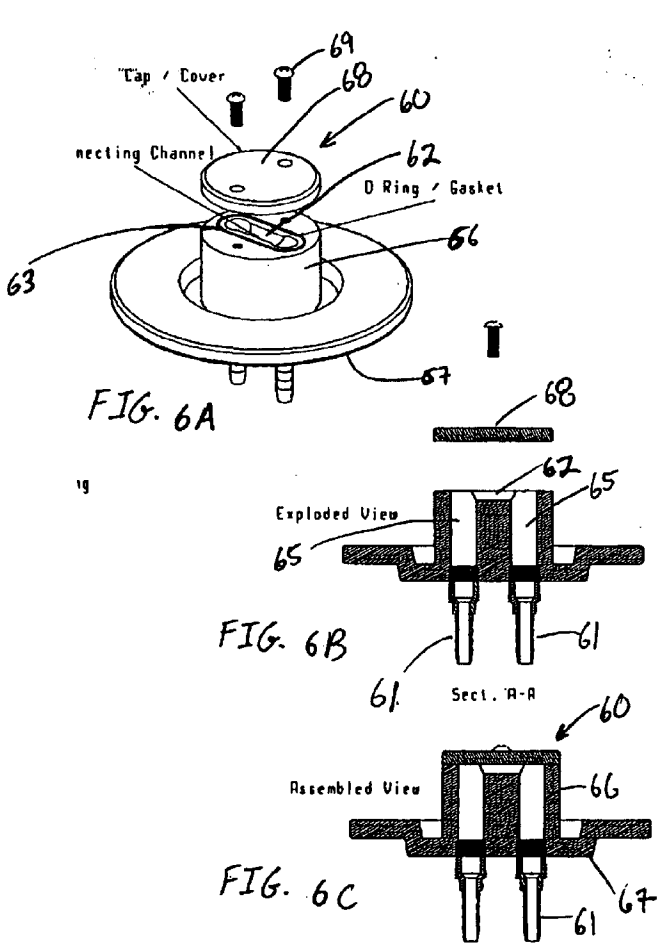
FIGS. 6A–6C represent another alternate embodiment of the fluid cooled T-yoke and speaker of the present invention.
Figures 5B, 5C, 6A:
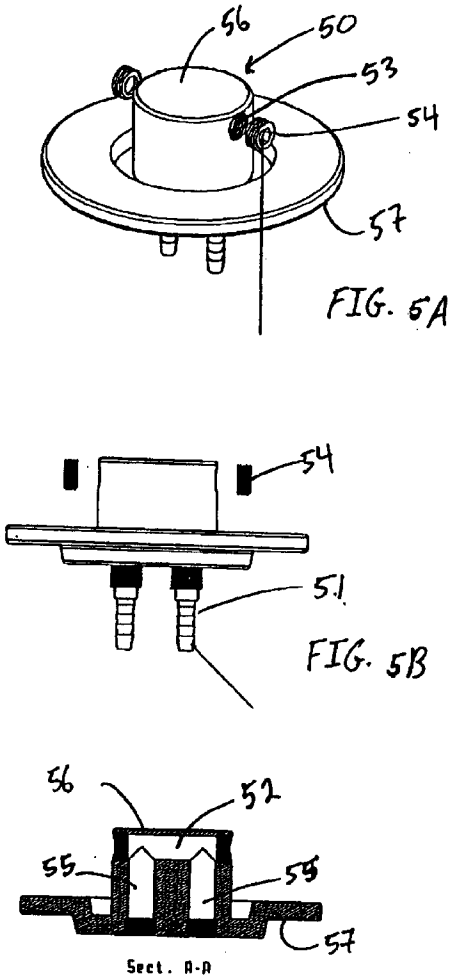

A still further embodiment is seen in FIGS. 5A–5C. Here, the fluid cavity is formed (as best seen in FIG. 5C) by drilling two vertical passages 55 thought base 57 and into pole piece 56. A horizontal connecting passage 52 is drilled through the upper portion of pole piece 56 such that vertical passages 55 will be connected. As suggested by FIG. 5A, the threaded apertures 53 remaining after the formation of passage 52 will be closed by way of threaded plugs 54 being inserted therein. Passage 52 could be made with or without the use of threads and a seal may be formed at the apertures 53 whether threaded or unthreaded by applying a heat resistant sealing compound such as liquid steel or epoxy. Alternatively, plugs 54 could be pressed or sintered into apertures 53 to form the necessary seals. FIG. 5B suggest how threaded fluid line fittings 51 will be inserted into the inlet and outlet apertures created at the bottom of vertical passages 55.

A still further embodiment is shown in FIGS. 6A–6C. In FIG. 6A, pole piece 66 is formed with a removable pole cap 68. As in FIGS. 5A–5C, vertical passages 65 will be drilled through base 67 and into pole piece 66. A cross channel 62 (see FIG. 6A) is then milled out of the top of the material separating the vertical passages 65. A gasket or O-ring 63 may be positioned around cross channel 62 and then pole cap 68 will be secured to pole piece 66 by way of screws 69. As before, threaded fluid line fittings 61 will be inserted into the inlet and outlet apertures created at the bottom of vertical passages 65.

FIGS. 7A–7D illustrate still another embodiment of the present invention. The embodiment in the FIG. 7 differs somewhat from previous embodiments in that the prior art air vented T-yoke 15 is converted to water cooled operation. As suggested in FIG. 7B, the vent aperture 19 will have threads 80 formed therein. These threads 80 will be engaged by a, threaded sleeve cup insert 82. Cup insert 82 has a threaded outer surface 86 and a cavity 84 formed within cup insert 82. A threaded base opening 88 is also formed at the bottom of cup insert 82. A fluid line fitting plug 81 will have a threaded collar 87 which is sized to engage the threads on base opening 88, with O-ring 83 forming a water tight seal between these elements. While not shown in the drawings, cup insert 82 could alternatively be formed without a threaded outer surface 86, but sized to create a tight friction fit within vent aperture 19. Cup insert 82 could then be pressed into place within vent aperture 19. Fitting plug 81 could also be formed without threaded collar 87. The base opening 88 on cup insert 82 could then be formed with an extended lip which would be rolled over the bottom of fitting plug 81 once fitting plug 81 was pressed into base opening 88.

Figure 7C:
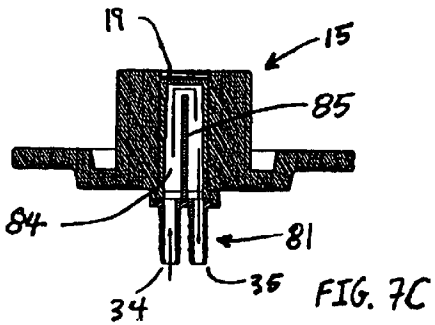
FIGS. 7A–7D illustrate still another embodiment of the fluid cooled T-yoke and speaker of the present invention.
Figure 7D:
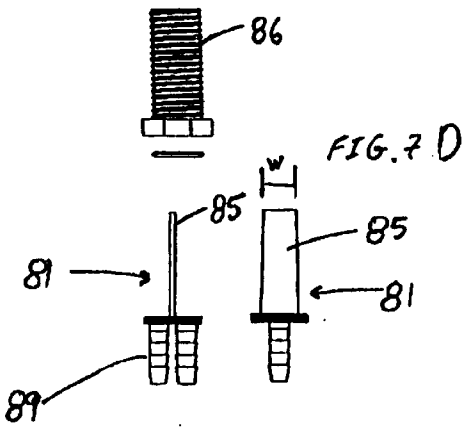
Figure 7A:
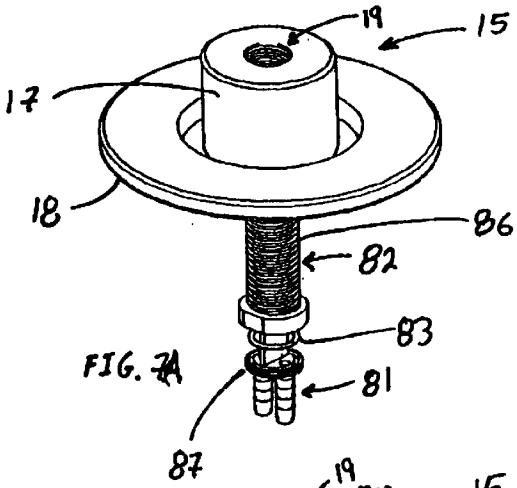
Figure 7B:
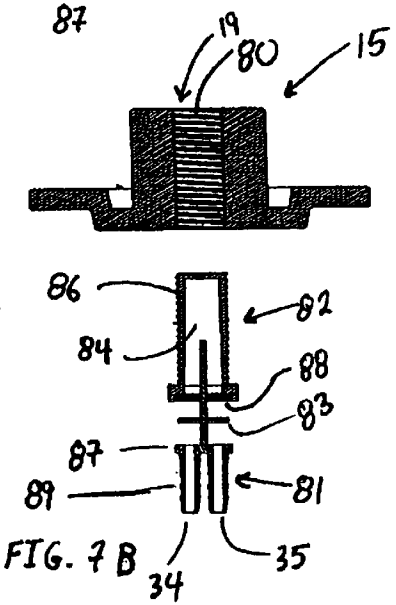

Fitting plug 81 will include two hose fittings 89 which form fluid inlet 34 and, outlet 35 and fitting plug 81 will further include a divider wall 85 (best seen in FIG. 7D) positioned above and between inlet 34 and outlet 35. FIG. 7D first illustrates fitting plug 81 with divider wall 85 seen from the side and further illustrates fitting plug 81 rotated 901 to show divider wall 85 from the front perspective. FIG. 7C demonstrates how sleeve cup insert 82 will be threaded into aperture 19 and fitting plug 81 threaded into base opening 88. In this configuration, the T-yoke 15 becomes mechanically equivalent to the previously disclosed embodiments of the T-yoke which had cavities formed directly in the pole piece. As shown by FIG. 7C, cooling fluid will enter cavity 84 through inlet 34, circulate around divider wall 85 and exit outlet 35. As seen in FIG. 7D, divider wall 85 has a width "w" which will be approximately the width of cavity 84. It is not necessary that divider wall 85 form a seal with the sides of cavity 84. It is only necessary that divider wall 85 is wide enough to direct a substantial portion of the cooling fluid entering cavity 85 over the top of divider wall 85 as opposed to around its sides. It will be understood that divider wall 85 performs the same function as extension tube 36 (seen in FIG. 3B) in that it forces fluid circulation in the upper portion of the cavity 85. Preferably, cup insert 87 will be constructed of a highly conductive material, such as metal (aluminum, iron, etc.), so that cup insert 87 will readily conduct heat from T-yoke 15 and allow transfer of the heat to fluid circulating through cavity 84.

Figure 8:
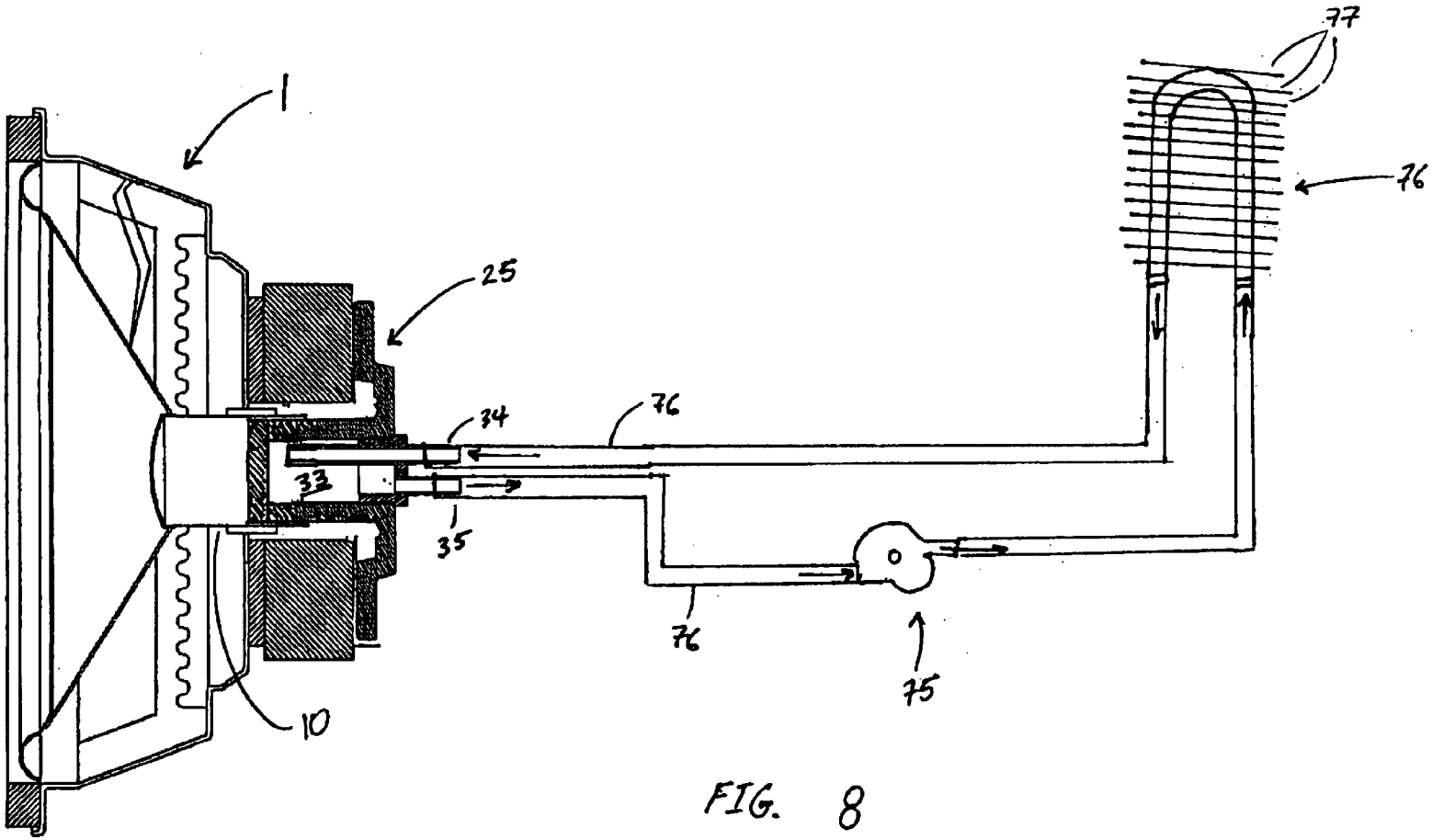
FIG. 8 represents the speaker of the present invention connected to a typical fluid cooling system.

FIG. 8 illustrates one embodiment of the fluid cooling system which will circulate cooling fluid to the fluid cooled speaker of the present invention. Speaker 1 is illustrated with the T-yoke 25 of the present invention. Heat from voice coil 10 will be transferred to T-yoke 25 and then to the fluid in cavity 33. The fluid in cavity 33 is circulated from outlet 35 to heat exchanger 76 by pump 75. As the fluid flows through heat exchanger 76, heat will be dissipated to the surrounding environment by vanes 77 on heat exchanger 76. The cooled fluid will then be circulated back to cavity 33 by way of inlet 34. It will be understood that FIG. 8 is illustrative of only one basic fluid cooling system. The system could also include a separate fluid reservoir integrated therein. Additionally, various types of conventional heat exchange mechanisms could be employed, including eliminating the heat exchanger 76 and allowing the heat transfer to occur in a fluid reservoir. There are also a large variety of fluids which could be used to cool the present invention. These fluids include water, glycol, a water/glycol mixture and numerous oils.

Although certain preferred embodiments have been described above, it will be appreciated by those skilled in the art to which the present invention pertains that modifications, changes, and improvements may be made without departing from the spirit of the invention defined by the claims. All such modifications, changes, and improvements are intended to come within the scope of the present invention.

I claim:

1. A fluid cooled T-yoke for a loudspeaker, said T-yoke comprising:

a. a body having a base and a pole piece with a sealed cavity formed within said pole piece, wherein said base has an aperture formed therein which communicates with said cavity and a base plug sealingly engages said aperture;

b. a fluid inlet formed in said body and fluidly communicating between said cavity and an area outside said body and wherein said fluid inlet and fluid outlet are formed through said base plug; and c. a fluid outlet formed in said body and fluidly communicating between said cavity and an area outside said body.

2. The fluid cooled T-yoke according to claim 1, wherein said cavity has an upper portion and one of said fluid inlet or outlet includes an extension tube extending into said upper portion of said cavity to insure fluid circulates through said upper portion.

3. A fluid cooled loudspeaker having a T-yoke with a pole piece, a magnet surrounding said pole piece, a voice coil positioned between said pole piece and said magnet, and a cone connected to said voice coil, said T-yoke comprising:

a. a body having a base and a pole piece with a sealed cavity formed within said pole piece, wherein said base has an aperture formed therein which communicates with said cavity and a base plug sealingly engages said aperture;

b. a fluid inlet formed in said body and fluidly communicating between said cavity and an area outside said body; and c. a fluid outlet formed in said body and fluidly communicating between said cavity and an area outside said body, wherein said fluid inlet and fluid outlet are formed through said base plug.

4. The fluid cooled loudspeaker according to claim 3, wherein said cavity has an upper portion and one of said fluid inlet of fluid outlet includes an extension tube extending into said upper portion of said cavity to insure fluid circulates through said upper portion.

5. A fluid cooled loudspeaker having a T-yoke with a pole piece, a magnet surrounding said pole piece, a voice coil positioned between said pole piece and said magnet, and a cone connected to said voice coil, said T-yoke comprising:

a. a body having a base and a pole piece with a sealed cavity formed within said pole piece;

b. a fluid inlet formed in said body and fluidly communicating between said cavity and an area outside said body;

c. a fluid outlet formed in said body and fluidly communicating between said cavity and an area outside said body; and d. wherein said pole piece and said base include a threaded aperture such that a threaded sleeve cup insert engages said aperture in order to form said sealed cavity within said body.

6. The fluid cooled loudspeaker according to claim 5, wherein a fluid line fitting plug engages a bottom section of said sleeve cup insert and said fluid line fitting plug has a dividing wall extending upwards therefrom.

* * * * *